United States Patent [19]

Borzoni

[11] Patent Number: 4,580,124

[45] Date of Patent: Apr. 1, 1986

[54] PLUG-IN FUSE ASSEMBLY

[75] Inventor: John M. Borzoni, Des Plaines, Ill.

[73] Assignee: Littelfuse, Inc., Des Plaines, Ill.

[21] Appl. No.: 640,841

[22] Filed: Aug. 17, 1984

[51] Int. Cl.[4] ..... H01H 85/22; H01H 69/02

[52] U.S. Cl. ..... 337/264; 29/623; 337/198

[58] Field of Search ..... 337/255-264, 337/198; 29/623

[56] References Cited

U.S. PATENT DOCUMENTS 4,023,265 5/1977 Aryamane ..... 337/264

4,099,320 7/1978 Schmidt, Jr. et al. ..... 29/623

*Primary Examiner*—Harold Broome

*Attorney, Agent, or Firm*—Russell E. Hattis; Stephen R. Arnold

[57] ABSTRACT

A plug-in fuse assembly comprises a housing made of insulating material and having relatively closely spaced vertical side walls bridged by vertical end walls and a metal plug-in fuse element having laterally spaced, generally parallel confronting terminals at the bottom thereof projecting downwardly from the bottom of said housing and upwardly extending current-carrying extensions of said terminals and a unique S-shaped fuse link extending between said current-carrying extensions. The current-carrying extensions have upper vertical outer margins which are inwardly offset from a given point to the tops thereof with respect to the corresponding vertical outer margins of the plug-in fuse element below the same, to provide clearance spaces for the downward passage of the vertical end walls of the housing, so that the overall width of the fuse is not significantly increased, if at all, by the housing end walls. The housing side walls are preferably staked into oval-shaped apertures in the current-carrying extensions which are provided with laterally inwardly projecting portions opposite these apertures, to increase the cross-sectional area of the current-carrying extension at these points.

16 Claims, 11 Drawing Figures

PLUG-IN FUSE ASSEMBLY

TECHNICAL FIELD OF INVENTION

Briefly, this invention relates to improvements involving the reduction in size of a plug-in fuse assembly like that disclosed in U.S. Pat. Nos. 3,909,767, 3,962,782, 4,099,320, and other patents. While these fuses were originally developed and still have their most important use as automobile fuses, they have other applications. More specifically, the invention relates to a substantial reduction in the size of the fuses disclosed in these patents facilitated by a unique construction thereof to be described.

BACKGROUND OF THE INVENTION

Both the miniaturized fuse of the invention and those disclosed in these patents preferably, but not necessarily, comprise an all fuse metal plug-in fuse element formed by stamping the same from a strip of fuse metal. The stamping forms a pair of laterally spaced juxtaposed, parallel terminal blade portions to be received by pressure clip terminals in a mounting panel, current-carrying extensions at the inner end portions of the pair of terminal blade-portions and a fuse link portion of very small cross-sectional area interconnecting the current-carrying extensions. The shape, placement and/or size and thickness of the fuse link determines the current rating of the fuse.

Generally, the method of making such a plug-in fuse assembly, and as disclosed in said U.S. patents, comprises providing a strip of fuse metal which is progressively blanked or stamped to provide longitudinally spaced, interconnected fuse-forming sections or blanks having the desired fuse element configurations as described. The spaced pairs of terminal blades are interconnected by transverse, relatively rigid webs when the fuse links are fragile. The exposed transverse webs interconnecting the pairs of terminal blades add rigidity to the strip and securely maintain the relative positions of the pairs of terminal blades, the current-carrying extensions thereof and the more fragile interconnecting fuse link, until a housing or the like is inserted over and secured to each blank. The housing is most advantageously (i.e. but not necessarily) a single piece molding preferably of transparent material having an opening at one end thereof, preferably its bottom end, which enables the housing to be readily inserted over the end most blank of the strip before it is severed from the rest of the strip, with the terminal blade portions and web positioned outside of the housing. Before the web is removed therefrom, the housing may be staked into apertures in the current-carrying extensions of the fuse metal element.

The fuse development which is the subject of the above-identified patents represents a major advance in the design of automotive fuses because the construction thereof permitted the reliable, automated, low cost production thereof, and it greatly reduced the overall size and volume of the fuses in comparison to those used previously for this purpose. With the recent increase in the number of separately fused circuits in automobiles, there has been an increased need to reduce the size of automotive fuses further, to increase the packing density thereof and decrease the space requirements of the fuse mounting blocks into which the fuses are plugged. To this end, the proposed commercial form of the present invention provides a fuse which is much shorter, narrower, thinner, and occupies much less volume than the previous fuse designs. The size reduction is facilitated by the unique shape of the all metal plug-in fuse element and its unique relationship to the housing applied thereover. Also, while some aspects of the invention do not so require, the preferred form of the invention utilizes a spacing between the confronting edges of the terminal blades which is similar to, preferably slightly greater than, that used in the larger fuses, so that the smaller fuses with narrower terminal blades can replace and be plugged into the same socket terminals as the larger fuses replaced thereby.

While the preferred form of the fuses disclosed in the aforesaid patents utilize a single piece housing with an open bottom for receiving the current-carrying extensions of the all metal fuse element, the broader aspects of the fuse design covered by the patents referred to encompass a two-piece housing used by a licensee under these patents as well as other housing configurations. The licensee's housing is a two piece housing, where the bottom part has an opening in the top thereof into which the terminal blade end of the all metal plug-in fuse element is inserted. The opening at the top of this bottom part of the housing assembly is closed by a cover piece placed and attached thereover. It was found that the former housing design having an opening at the bottom rather than at the top thereof is especially suitable for the design of a smaller fuse which is the subject of the present invention.

SUMMARY OF THE INVENTION

In accordance with one of the features of the present invention, in order to reduce the width of the overall fuse design, instead of designing the current-carrying extensions of the terminal blades as before, where their vertical outer margins were a vertical in-line extension of corresponding margins of the terminal blades for their full height, the vertical outer margins of the current-carrying extensions are offset inwardly, to provide an upwardly facing shoulder and clearance spaces thereabove for downward passage of the end walls of a narrow housing open at the bottom thereof. Thus, the end walls of the housing fit within these clearance spaces, and the bottom of the housing can, if desired, rest on these shoulders which can form convenient stop shoulders for limiting downward insertion of the housing over the all metal plug-in fuse element. The outer faces of the housing end walls are substantially in alignment with the outer vertical margins of the terminal blades, unlike the previous design where the housing projected substantially horizontally beyond the vertical margins of the terminal blades.

These fuses are desirably positioned in their fuse mounting blocks so that their side faces are in close confronting relationship, where the pair of terminal blades of each fuse are closely spaced in a direction transversely to the positioning line of the fuses where there is little or no space to grasp the side faces of the fuse. Manual removal of a fuse from the fuse block thus makes desirable the provision of overlapping housing portions at least at the opposite ends of the top of each fuse housing. The resulting downwardly facing shoulders or lips at the ends of the fuse housing can be conveniently gripped for removal of the fuse from the fuse block. These lips in the present invention project horizontally from points on the housing substantially vertically aligned with the vertical outer margins of the terminal blades, rather than at points spaced substantially outwardly from these margins, as in the prior design of the larger fuses.

It will be recalled that, in the preferred embodiment of the invention the housing is anchored to the all fuse metal plug-in element by staking the element into apertures in the current-carrying extensions thereof. Previously, these apertures were of rectangular shape. It has been found that the sharp corners of these apertures are the cause of occasional cracking of the housing at these points. A specific unique feature of the new fuse design is to round off the corners of the apertures. The apertures are preferably of a vertically elongated oval shape.

As previously indicated, these apertures can form undesirable hot spots in the fuse if current must flow between the terminal blades and fuse link through the staking aperture-containing portions of the current-carrying extensions. Thus, these apertures reduce the cross-sectional areas of the fuse metal and form areas of highest resistance where appreciable heat can be generated at abnormally high current levels. This heat can adversely effect the blowing conditions of the fuse, sometimes damage the housing or weaken its connections with the plug-in fuse element. In the larger predecessor fuses, these apertures were found to cause this problem at the higher amperage ratings, such as 30 amps, if current was permitted to flow through the apertured portions of the fuse metal plug-in element. For this reason, the fuse links of 30 amp fuses were placed below the staking apertures. Because the fuses of the invention which replace these larger fuses are so much smaller than the prior fuses they replaced, the practical upper limit for rated current of the new fuses is expected to be about 20 amps in those cases where current flows through the staking aperture portions of the fuse.

The offsets described formed in the current-carrying extensions of the miniaturized fuse of the present invention undesirably reduce the cross sectional area of the current-carrying extensions of the terminal blades at these points of the fuse. In accordance with another feature of the present invention, the metal lost by the provision of each offset in the current-carrying extensions which can cause a hot spot, is recovered, at least in part, by providing laterally inwardly projecting extensions of the inner vertical margins of the current carrying extension involved below them, so that the cross sectional area of the all fuse metal element at this point is satisfactorily large, to minimize the possibility of hot spot problems. In the previous fuse designs, the inner vertical margins of the current-carrying extensions had no such laterally inwardly projecting extensions.

In addition to the features of the invention which facilitate size reduction just described, another important feature of the invention relates to a uniquely sized and positioned S-shape fuse link. (While FIG. 14 of U.S. Pat. No. 4,099,320 shows a similarly shaped fuse link for only 5 and 7½ amp fuses, the size and placement thereof is completely different from the unique fuse link to be described used for fuse ratings, for example, of from 1 to 20 amps.) This uniquely sized and positioned S-shaped fuse link fuse is advantageous for large ranges of fuse ratings since it provides for increased length of the fuse link desirable for the lowest current ratings and is still useable at higher current ratings when its width and thickness are increased. Thus, the increased length obtained by the unique fuse link design facilities the reliable manufacture of fuses at ratings, for example, from 20 amps down to about 10 amps or less, without the need for reduction in the element thickness, as was used in the larger correspondingly rated predecessor fuses. Also, it similifies computer-assisted design of the fuses for the various fuse ratings, and facilitates the reliable manufacture of the lowest rated fuses (i.e. 3 amps and less) as well as the higher rated fuses. In the predecessor design, highly reliable fuses below 3 amps were especially difficult to produce at low cost. Furthermore, the increased length provided by the unique fuse link shape provides improved delay characteristics when the fuse is subjected to transient or normal in-rush currents which might otherwise produce undesired premature blowing of the fuses.

The above and other features and advantages of the invention will become apparent upon making reference to the specification and claims to follow and the drawings.

DESCRIPTION OF THE PREFERRED EMBODIMENT OF THE INVENTION

Referring now more particularly to FIGS. 1–4, there is shown a preferred plug-in fuse assembly 2 of the invention. This assembly is made of only two component parts, namely an all metal plug-in fuse element 4, which is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking and ultrasonic welding operation.

Figure 1:
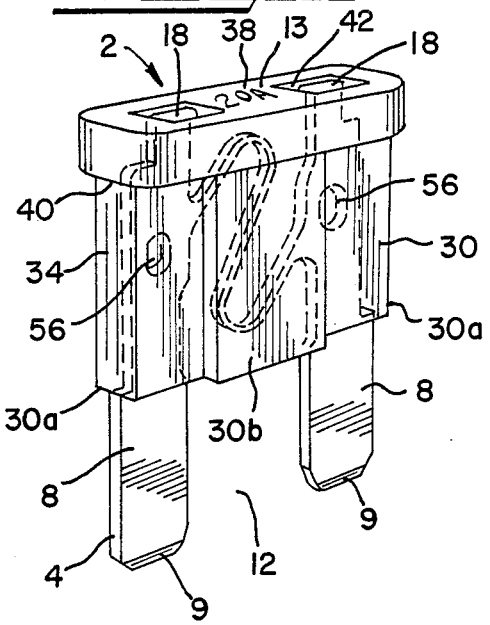
FIG. 1 is a perspective view of a preferred form of the plug-in fuse assembly of the invention.
Figure 2:
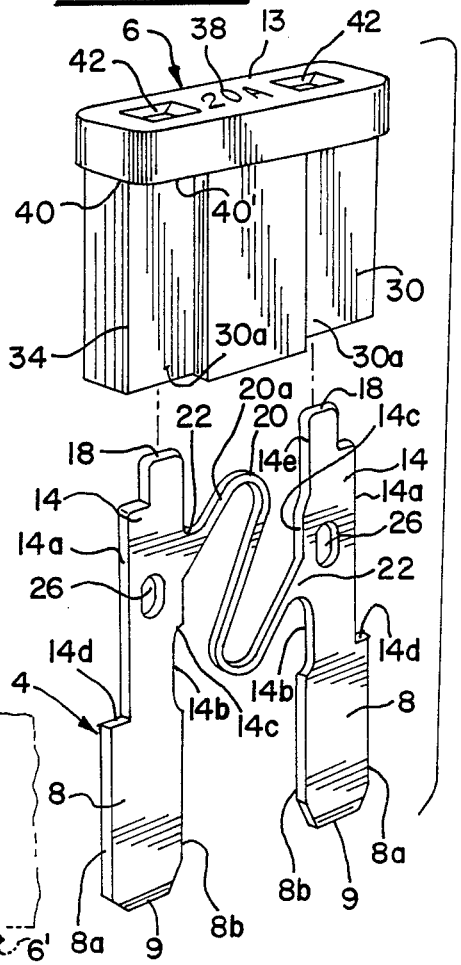
FIG. 2 is an exploded view of the housing and plug-in fuse element of FIG. 1.
Figure 4:
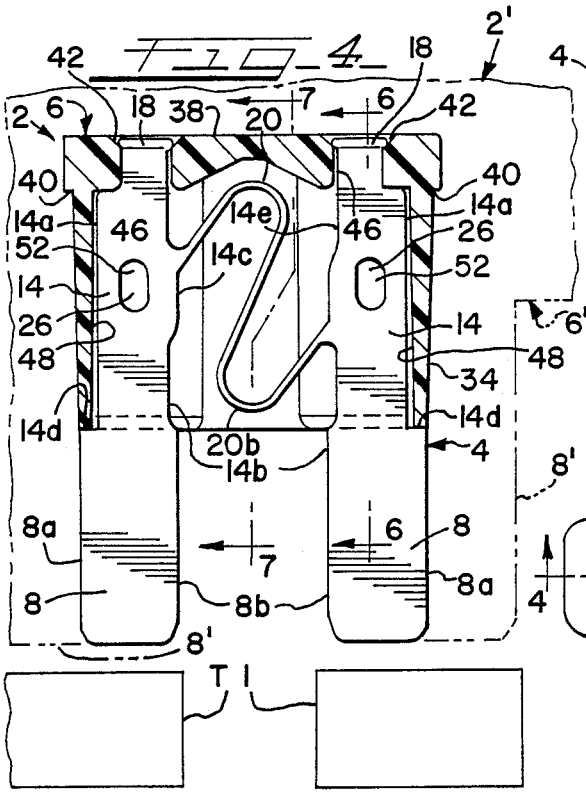
FIG. 4 shows in solid lines a vertical longitudinal sectional view through the plug-in fuse assembly shown in FIG. 3, taken along section line 4—4 therein, and pressure clip terminals therebelow designed for receiving the terminal blades of the predecessor fuse. The figure also shows in dashed lines the outlines of the terminal blades and part of the housing of the larger predecessor fuse.
Figure 3:
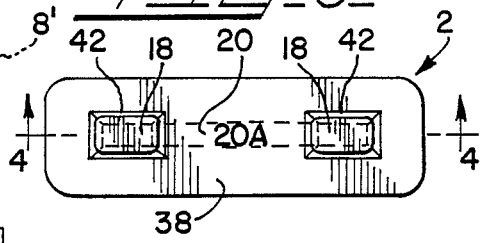
FIG. 3 is a top plan view of the plug-in fuse assembly of FIG. 1.

The plug-in fuse element 4 has terminal blade portions 8—8 plated with a highly conductive metal like tin and extending downwardly in spaced parallel juxtaposed relationship from the inner or bottom margin of the housing 6. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals T1 (FIG. 4). The current rating of the plug-in fuse assembly as indicated by indicia 20 on the outer wall 38 of the housing and/or by a distinctive housing color.

The all metal plug-in element 4 may be formed from a partially or completely tin plated strip of fuse metal (not shown) from which longitudinally spaced interconnected fuse blanks are stamped. Prior to the plug-in fuse element being severed from the strip, the terminal blade portions 8—8 may be interconnected by a transverse rigidifying web (not shown) stamped preferably but not necessarily from a reduced coined, milled or skived central portion of the strip, as disclosed in some of said patents where the fuse link is to be thinner than the rest of the plug-in fuse element 4. The stamping operation also forms the terminal blade portions 8—8 separated by a gap 12. The tapered portions 9—9 of the terminal blade portions 8—8 may be formed by coining dies preferably after the operation which severs the plug-in fuse element from the strip.

The terminal blade portions 8—8 have current-carrying extensions 14—14 which are also preferably tin plated including the outer end portions thereof where checking probe-receiving tabs 18—18 are formed. The current-carrying extensions project into the aforementioned space formed by the housing 6 where they are contiguous to the front or outer wall of the housing to be described. The current-carrying extensions 14—14 are interconnected by an unplated or plated fuse link portion 20 which is shown narrower in width than the other current-carrying portions of the plug-in fuse element 4. Except for this fuse link portion, the size and thickness of the rest of the plug-in fuse element is sufficient to form a rigid, self-supporting structure, as shown by the drawings. However, as previously indicated, the plug-in fuse element of especially large current rated fuses could have the same thickness as the other portion of the plug-in fuse element. The current-carrying capacity of the fuse link portion 20 may be varied by varying its location and its configuration including its width, length and thickness dimensions. In the preferred embodiment of the invention, the median length of the fuse link remains the same for most, if not all, current ratings. In the particular configurations of the plug-in fuse element 4 shown in FIGS. 2 and 4, the fuse link portion 20 is preferably of a unique S-shaped configuration to be described, not used in the predecessor design, and the current-carrying extensions 14—14 join the fuse-forming link portion 20 of the plug-in fuse element 4 by tapered portions 22—22. All of the various parts of the plug-in fuse element are shown substantially in coplanar relation. To anchor the plug-in fuse element 4 within the housing 6, staking of anchoring apertures 26—26 are formed in the current-carrying extensions 14—14 to receive anchoring projections to be described formed in the housing walls.

The fuse link portion 20 shown in the drawings terminates in an upper end portion **20*a* joining the left current-carrying extension 14 at a point above the staking aperture 26 therein. The fuse link portion 20 has a lower end portion 20*b* which joins the right current-carrying extension 14 at a point below the associated staking aperture 26. The unique shape of this fuse link portion 20 will be later described. Thus, current which flows between the fuse link portion 20 and the left terminal blade portion will flow through the apertured portion of the left current-carrying extension while current does not do so in the apertured portion of the right current-carrying extension 14**. However, the basic configuration of the terminal blade and current-carrying extension portions are standardized for the different configurations used in the fuse link portions, so that common mechanical staking and ultrasonic welding equipment can be used for all fuses.

Figure 11:
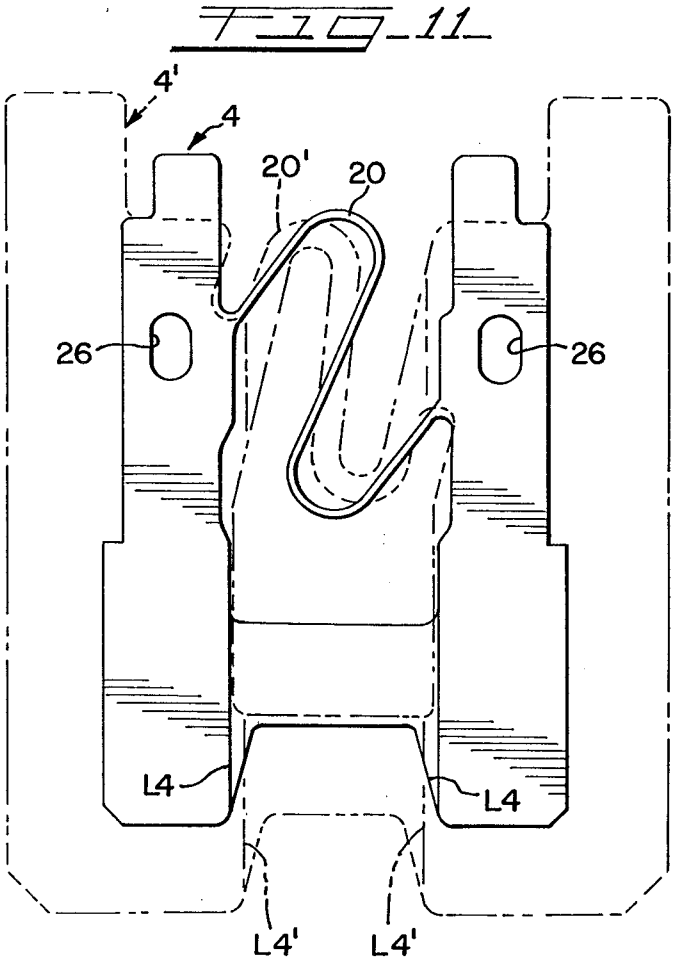
FIG. 11 is a view corresponding to that shown in FIG. 9 for 7½ amp rated fuses for the invention and predecessor fuse.
Figure 10:
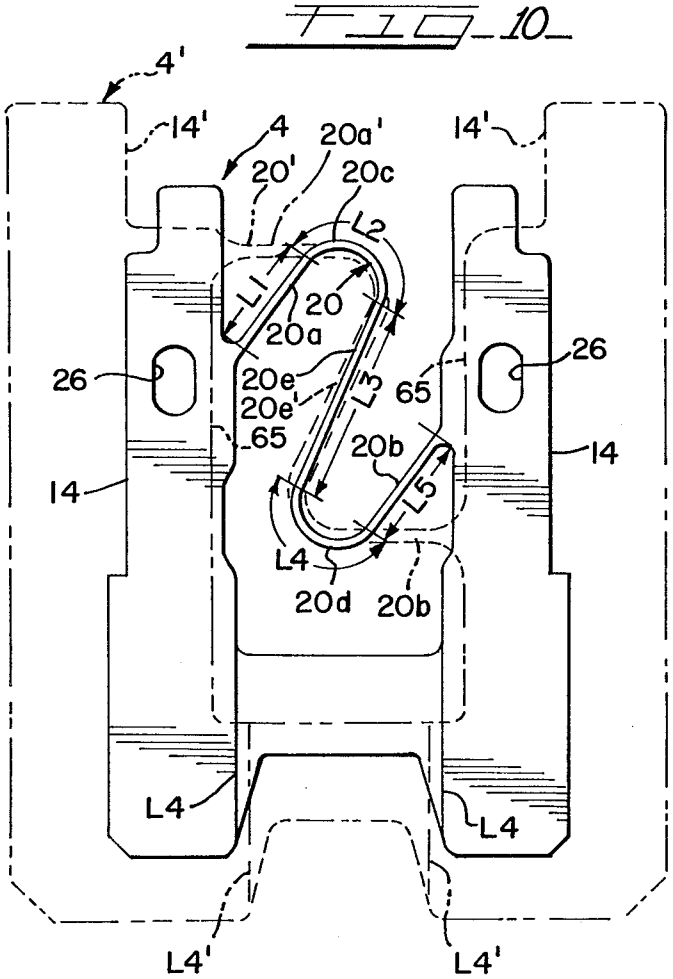
FIG. 10 shows in solid lines the outlines of the all metal plug-in fuse element of the fuse assembly of the present invention and in dashed lines the outline of the plug-in fuse element of corresponding predecessor larger fuse, for 3 amp rated fuses.

In accordance with the preferred form of the present invention as previously described, it is desired that the spacing between the confronting inner edges **8*b*—8*b* of the terminal blade portions 8—8 be similar and preferably somewhat larger than that of the much larger predecessor fuses which they were designed to replace, as best shown by FIGS. 4, 10 and 11. Thus, FIGS. 4, 10 and 11 show in solid lines the fuse 2 of the invention and in dashed lines the outlines of part of the larger fuse 2' which it replaced. Since, as there shown, the spacing between the confronting edges 8*b*—8*b* of the narrower terminal blade portions 8—8 of the fuse 2 of the present invention are spaced apart about the same, and preferably a somewhat greater distance than the terminal blade portions 8'—8' of the larger fuse 2' it replaces, the fuse 2 is pluggable into the same but wider spring clip terminals T1 shown in FIG. 4, made for the larger fuse 2'** and, more importantly, will adapt to spring clip terminals of similar inner spacing but of smaller overall width and correspondingly reduced size fuse mounting blocks.

The confronting inner edges **8*b*—8*b* of the terminal blade portions 8—8 of the fuse 2 merge with inwardly offset vertical inner margins 14*b*—14*b* of the current-carrying extensions 14—14. The terminal blades 8—8 are preferably of a consistent width up to the point where that portion of the plug-in fuse element passes into the housing 6**. Maintaining this consistent width over the full length of these exposed terminal blades reduces the electrical resistivity where the fuse engages the external terminals, and increases the thermal conductivity and current-carrying capacity of the fuse.

The inwardly offset confronting margins **14*b*—14*b* of the current-carrying extensions 14—14 of the terminal blade portions 8—8 starting immediately above the terminal blade portions are provided to increase the spacing D1 (FIG. 8) between the lower loop of the fuse link portion 20 and the left current-carrying extension. This increases the width and mechanical strength of the portion of the manufacturing punch used to punch out this portion of the all metal plug-in fuse element 2 from the strip of fuse metal, as previously described in the introductory part of this application. It should be appreciated that the punch needed to punch out that portion of the all fuse metal plug-in fuse metal element 4 to the left of the fuse link portion 20 shown in FIG. 4 becomes especially weak if the punch becomes unduly narrow at the points thereof spaced substantially from the upper end thereof. For similar reasons, it is desirable to maximize the spacing between the upper loop of the fuse link portion 20 and the inner vertical margin of the upper end of the right current-carrying extension 14, that is along the inner vertical margin 14***e* of the right current-carrying extension 14.

The upper ends of the offset inner vertical margins 14*b*—14*b* of the current-carrying extensions 14—14 are shown merging with laterally projecting portions 14*c*—14*c* at points horizontally opposite the anchoring apertures 26—26. The laterally projecting portions 14*c*—14*c* of the current-carrying extensions are absent in the previous fuse for reasons to be explained.

As illustrated in FIGS. 4, 10 and 11, the current-carrying extensions 14—14 within the housing 6 have inwardly offset outer vertical margins 14*a*—14*a* forming upwardly facing stop shoulders 14*d*—14*d* and clearance spaces for the narrow end walls 34—34 of the housing 6. These end walls in previous fuse designs projected substantially horizontally beyond the vertical outer margins of the current-carrying extensions 14—14, as indicated by dashed line 6' in FIG. 4. In the present invention, the outer surfaces of the housing end walls 34—34 are close to or are in substantially vertical alignment with the outer vertical margins 8*a*—8*a* of the terminal blade portions 8—8 of the plug-in fuse element 4. As also best shown in FIG. 4, the widths of the terminal blade portions 8—8 and the current-carrying extensions 14—14 of the exemplary fuse 2 of the invention illustrated in the drawings are approximately one-half the width of the corresponding portions of the larger predecessor fuse 2' which the fuse 2 replaces. The laterally projecting portions 14*c*—14*c* of the current-carrying extensions 14—14 make up for part of the loss of metal caused by the inward offsetting of the outer vertical margins 14*a*—14*a* of the current-carrying extensions 14—14, so that a desired cross-sectional area of fuse metal material is present opposite the staking apertures 26—26 to avoid hot spots. If desired, these inwardly extending portions 14*c*—14*c* could be extended inwardly much further than that shown in the drawing if necessary to eliminate unsatisfactory hot spots, and the thickness of the fuse metal could be increased, if desired.

Exemplary specifications for a 20 amp rated fuse are as follows:

- width of current-carrying extensions 14—14 below the apertures 26—26 and the inwardly extending portions 14*c*—14*c*=0.080 inches
- width of current-carrying extensions 14—14 at the aperture 26—26=0.094" inches
- vertical dimensions of apertures 26—26=0.062 inches
- width of apertures 26—26=0.035 inches
- thickness of fuse metal=0.025 inches
- fuse metal resistivity=40 ohms/circular mil-foot at 20° C.
- overall vertical height of blades and extensions 14 and 18=0.585 inches
- housing composition=Polycarbonate resin (General Electric 141 RR-112 resin) or Polysulphone resin (Union Carbide P 1700 resin)

It will be recalled that another unique feature of the invention has to do with the design of the S-shape fuse link portion 20 of the all fuse metal plug-in fuse element 4. To best understand this uniqueness, reference should be made to FIG. 10 which shows the all fuse metal plug-in fuse element 4' of the larger predecessor 3 amp fuse (the lowest reliable current rated fuse previously sold for automotive purposes) and the correspondingly rated all fuse metal plug-in fuse element 4 of the preferred form of the fuse of the present invention. It will be noted that the Z-shaped fuse link 20' of the predecessor fuse element 4' has straight horizontal upper and lower end portions or legs 20*a'* and 20*b'* joining the current-carrying extensions 14'—14' near the upper or lower ends thereof, whereas the upper and lower end portions 20*a* and 20*b* of the preferred fuse of the present invention incline preferably at an angle of about 45 degrees and join the current-carrying extensions 14—14 at points in the central portions thereof near but above and below the left and right staking apertures 26—26 respectively. The fuse link portion 20 has a straight central leg 20*e* extending at inclined angles corresponding to that of the straight central leg 20*e'* of the predecessor fuse and similar to the angles of inclination of the outer legs 20*a* and 20*b* thereof. The overall length of the fuse link portion 20 is thus substantially greater than the overall length of the fuse link portion 20' of the predecessor fuse.

It is to be noted that the S-shaped fuse link shown in FIG. 14 of U.S. Pat. No. 4,099,320, while having a fuse link of similar shape to the present fuse, is of such small size, being located completely above the staking apertures and joining the current-carrying extensions at about the same corresponding points thereon, that none of the advantages of the present S-shaped fuse link is achieved thereby.

The fuse link portion 20 of the 3 amp fuse of FIG. 10 has the same median path length and shape as that of the fuse link portion 20 of the 7½ amp fuse of FIG. 10 and the fuse link portions for fuses down to 1 amp and up to 20 amps. In FIGS. 10 and 11, the skive lines L4 and L4' are shown which define the lines of demarcation between the thicker and thinner portions of the all fuse metal plug-in fuse elements 4 and 4' thereshown, since these lower amperage fuses have thinner, more elongated fuse link portions than the 20 amp fuse of FIGS. 1–4 which have the same thickness as the rest of the plug-in fuse element 4 thereof. It is noted that the Z-shaped fuse link portion 20' for the 7½ amp predecessor fuse shown in FIG. 11 has a completely different shape and width than the Z-shaped fuse link 20' of the 3 amp fuse shown in FIG. 10.

Figure 8:
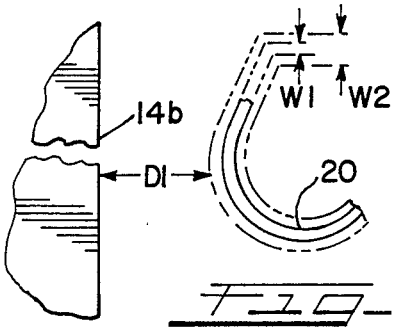
FIG. 8 is a fragmentary elevational view showing in solid lines a portion of one current-carrying extension and the adjacent portion of the S-shaped fuse link of the lowest amperage fuse, and shows in dashed lines the greater width of the fuse link used in the highest amperage fuses.
Figure 9:
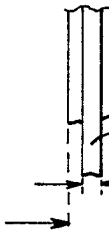
FIG. 9 is a view of the smallest and highest amperage fuse links shown in FIG. 8 as viewed at right angles thereto.

In general, as the current ratings of the fuses of the present invention increase from 1 amp, as best shown in FIG. 8, the distance D1 between the looped portions 20*c* and 20*d* of the fuse link portion 20 of the fuse will decrease. The width of the lowest amperage fuse (such as 1 amp in the example of the invention described) is shown in dashed lines in FIG. 8 with a minimum width W1 and that of the highest amperage fuse is shown in solid lines with a maximum width W2, where the distance D1 between the fuse link and current-carrying extension is at a minimum. As previously indicated, this minimum distance D1 is limited so that the portion of the punch which forms this portion of the element can be readily made with adequate strength. Such a minimum distance may be, for example, 0.057". FIG. 9 shows the minimum and maximum thickness t1 and t2 respectively used for the lowest and highest amperage fuses. Exemplary thickness for t1 and t2 are 0.004" and 0.025", respectively.

FIG. 10 shows the fuse link segment lengths L1, L2, L3, L4 and L5 for the various contiguous segments of the S-shaped fuse link portion illustrated therein. These segment lengths may be 0.084", 0.108", 0.173", 0.108" and 0.084", respectively.

The unique S-shaped configuration of the present invention not only has the various advantages previously described, but it provides a most reliable fuse because it isolates to an optimum degree the central portion of the centermost leg where the fuse blows from the various heat generating portions of the fuse. Thus, the various legs of the preferred fuse link have relatively narrow and long profiles providing the maximum separation thereof. As shown in FIG. 11, this isolation is much greater in the case of the plug-in fuse element 4 of the invention than it is for the predecessor plug-in fuse element 4' where the outer end portions of the fuse filament 20' are spaced much closer to the center leg thereof.

Figure 5:
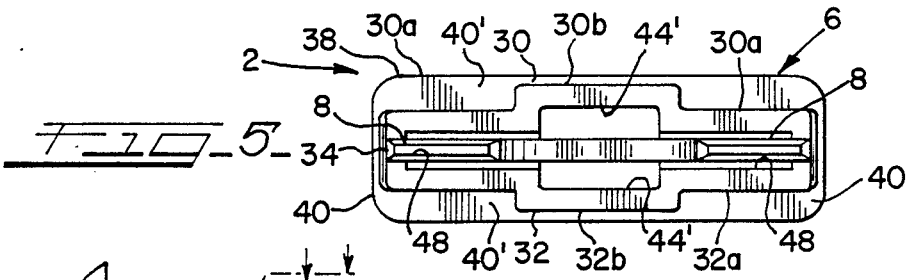
FIG. 5 is an enlarged bottom view of the plug-in fuse assembly of FIG. 1.
Figure 6:
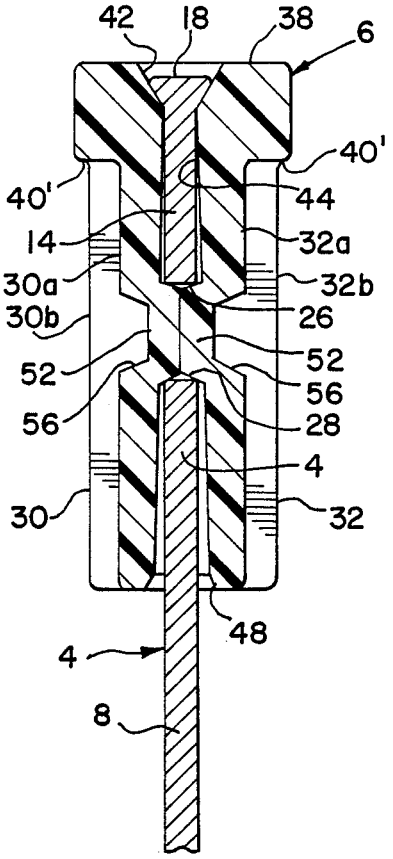
FIG. 6 is an enlarged transverse vertical sectional view through the plug-in fuse assembly shown in FIG. 4, taken along section line 6—6 thereof.
Figure 7:
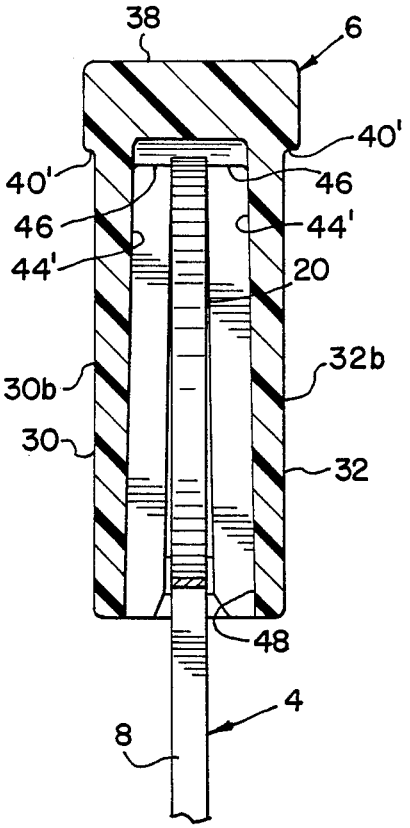
FIG. 7 is an enlarged vertical transverse sectional view through the center portion of the plug-in fuse assembly shown in FIG. 4, taken along section line 7—7 thereof.

While the housing 6 could be made in separate parts snappable or otherwise secured together to form a single piece at the time the housing is assembled, the housing is most advantageously a single piece integral molded part as shown. Also, it preferably has relatively closely spaced side walls generally indicated by reference numeral 30–32 (FIGS. 6–7), the side walls having end portions **30*a*–32*a* which are spaced together much more closely than the central or intermediate portions 30*b*–32*b* thereof. The side walls 30–32 are interconnected at their end margins by the narrow end walls 34—34 (FIG. 5), and at their outer or top margins by the outer wall 38 (FIG. 6) which overhangs the rest of the housing to form downwardly facing shoulders 40—40 at the longitudinal ends of the outer wall 38 and downwardly facing shoulders 40'—40' along the longitudinal side margins of the housing 6**.

Terminal access openings 42—42 are provided in the outer wall 38 adjacent the opposite end portions thereof in alignment with the location of the test probe-receiving tabs 18—18 of the plug-in fuse element 6. The walls of the terminal access openings 42—42 taper down to an inner dimension which approximates the width of the test probe-receiving tabs 18—18 so that test probes can be guided into contact with the tabs 18—18. The tabs 18—18 are preferably peened to further anchor the housing 6 to the plug-in fuse element 4. The terminal access openings 42—42 communicate with the aforementioned plug-in fuse element receiving space in the housing 4. The portions 44—44 of this space immediately beneath the access opening 42—42 are relatively small because of the close spacing of the side wall portions **30*a*–32*a* of the housing at these points, the width of the space portion 44—44 as viewed in FIG. 6 tapering from the bottom open end of the housing upwardly toward the terminal access openings 42—42, reaching a narrow dimension about equal to the thickness of the plug-in fuse element 4. At the inner margins of the terminal access openings 42—42 the upper wall 38 is provided with downwardly extending skirts 46—46 (FIG. 4) which act as shield walls to prevent spewing fuse metal from gaining entrance to the terminal access openings 42—42. These skirts 46—46 also increase the strength of the upper wall 38 which had to be thinned somewhat in the middle thereof to provide substantial spacing of the housing from the upper loop 20*c* of the fuse link 20**.

The fuse link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion of the end blank of the pre-stamped and preferably milled strip from which a completed fuse element is punched and immediately following this operation the housing 6 is secured by staking to the end portion or end blank of the strip, as previously indicated.

The housing 6 is preferably a molded part made of a transparent synthetic plastic material so that the fuse link portion 20 of the plug-in fuse element 4 is readily visible through the housing walls.

While the housing interior could be made with resilient projections which snap into the anchoring apertures 26—26 in the plug-in fuse element 4, it is preferred to secure the housing in place by forming projections 52 from both sides of the housing 6 by first a mechanical staking operation, which projections enter the anchoring apertures 26—26 of the plug-in fuse element 4. The inwardly extending projections 52 formed by the mechanical staking operation where they engage each other in the anchoring apertures or openings 26 are preferably later ultrasonically welded together by ultrasonic welding or the like to provide a more rigid and structurally stable anchoring structure. The depressions 56 left by the staking operation are shown in the side wall 30 in FIGS. 1 and 6.

As previously indicated, the anchoring apertures 26—26 of the previous fuse design were rectangular in shape. However, to eliminate cracking of the synthetic plastic material in some cases due to the sharp corners of these apertures, it was found most desirable that this aperture be made of a vertically elongated oval shape. It is vertically elongated to minimize the width of the aperture to reduce the cross-sectional area of the current-carrying extensions 14—14 at this point to a more modest degree.

The exemplary embodiments of the fuse assemblies described have thus provided exceedingly compact plug-in fuse assemblies which can be readily inserted into and removed from suitable closely spaced spring clip terminal connectors in a mounting panel by manually grasping the shoulders 40—40 at the longitudinal ends of the housing 6 or by a tool which can engage these or the side shoulders 40'—40'.

It should be understood that numerous modifications may be made in the most preferred form of the invention described without deviating from the broader aspects of the invention. For example, while the invention has its most important application in the fuse having an all metal fuse plug-in element, the teachings of the invention are also applicable to fuses where the terminal blades are made of a material other than fuse metal or is a fuse metal foil placed over a core of insulation material. Also, where the entire terminal blades are made of a metal other than fuse metal, the fuse link may be a separate element soldered or otherwise connected between the current-carrying extensions involved.

I claim:

1. In a plug-in fuse assembly comprising a housing made of insulating material and having relatively closely spaced vertical side walls bridged by vertical end walls; a metal plug-in fuse element having laterally spaced, generally parallel confronting terminals at the bottom thereof projecting downwardly from the bottom of said housing, upwardly extending current-carrying extensions of said terminals and a fuse link extending between said current-carrying extensions; at least upper portions of said current-carrying extensions and said fuse link being enclosed by said housing; said housing being initially open at the bottom thereof for the full width of the plug-in fuse element so as to be slippable over the upper end portion of the plug-in fuse element into its desired position; and said housing and plug-in fuse element having interconnecting means for securing the plug-in fuse element within the housing, the improvement wherein said upwardly extending current-carrying extensions have upper vertical outer margins which are inwardly offset from a given point to the tops thereof with respect to the corresponding vertical outer margins of the plug-in fuse element below the same, to provide clearance spaces for the vertical end walls of said housing which occupy said spaces, so that the overall width of the fuse is not significantly increased, if at all, by the housing end walls.

2. In a plug-in fuse assembly comprising a housing made of insulating material and having relatively closely spaced vertical side walls bridged by vertical end walls; a metal plug-in fuse element having laterally spaced, generally parallel confronting terminals at the bottom thereof projecting downwardly from the bottom of said housing, upwardly extending current-carrying extensions of said terminals and a fuse link extending between said current-carrying extensions, at least upper portions of said current-carrying extensions and said fuse link being enclosed by said housing; and said housing and plug-in fuse element having interconnecting means for securing the plug-in fuse element within the housing, the improvement wherein said upwardly extending current-carrying extensions have upper vertical outer margins which are inwardly offset to provide clearance spaces for the vertical end walls of said housing which occupy said spaces, so that the overall width of the fuse is not significantly increased, if at all, by the housing end walls.

3. The plug-in fuse assembly of claim 1 or 2 wherein said plug-in fuse element is made entirely of fuse metal and has a co-planar, plate-like shape, the plane thereof extends substantially parallel to the vertical side walls of said housing.

4. The plug-in fuse assembly of claim 1 or 2 wherein said housing is a single, integrally molded piece of synthetic plastic material.

5. The plug-in fuse assembly of claim 1 or 2 wherein the upper margins of said housing end walls terminate in slightly laterally outwardly projecting portions forming downwardly facing gripping shoulders for removal of the plug-in fuse assembly from pressure clip terminals.

6. The plug-in fuse assembly of claim 1 or 2 combined with a pair of fuse terminal receiving socket terminals spaced apart a distance corresponding to the widths of said fuse terminals, but each having a width substantially wider than the width of the terminals of the plug-in fuse element, to accommodate much wider terminals of a much larger plug-in fuse assembly.

7. The plug-in fuse assembly of claim 1 or 2 wherein said interconnecting means include anchoring aperture means in said current-carrying extensions, the anchoring aperture means in at least one of said current-carrying extensions being positioned on the terminal side of the point of connection of an end of said fuse link to the associated current-carrying extension, so that current flow between the terminals and said end of said fuse link must pass through the portion of the current-carrying extension including said aperture means, and the inner vertical margin of each current-carrying extension in which current flows through the apertured portion thereof between a terminal and fuse link having a laterally inwardly projecting portion opposite each such apertured portion, to increase the cross-sectional area of the current-carrying extension at this point thereof, to minimize the possibility of developing hot spots which could damage or alter the blowing characteristics of the fuse.

8. The plug-in fuse assembly of claim 2 wherein said interlocking means include anchoring aperture means in said current-carrying extensions, the anchoring aperture means in at least one of said current-carrying extensions being positioned on the terminal side of the point of connection of an end of said fuse link to the associated current-carrying extension, so that the current flow between the terminals and said end of said fuse link must pass through the portion of the current-carrying extension including said aperture means, and the inner vertical margin of each current-carrying extension in which current flows through the apertured portion thereof between a terminal and fuse link having a laterally inwardly projecting portion opposite each such apertured portion, to increase the cross-sectional area of the current-carrying extension at this point thereof, to minimize the possibility of developing hot spots which could damage or alter the blowing characteristics of the fuse, and said anchoring aperture means are oval-shaped apertures.

9. The plug-in fuse assembly of claim 8 wherein said oval-shaped apertures are vertically elongated apertures.

10. The plug-in fuse assembly of claim 2 wherein; said current-carrying extensions have apertures therein, said housing side walls extending into said apertures to anchor the housing and plug-in fuse element together, and said apertures being oval-shaped so as to be devoid of sharp corners, the long dimension thereof being parallel to the direction of extension of said terminals.

11. The plug-in fuse assembly of claim 10 wherein said apertures are vertically elongated oval-shaped apertures.

12. The plug-in fuse assembly of claim 10 wherein said fuse link has a double undulating configuration with an upper leg joined to and inclining away in a given direction from a portion of the inner vertical margin of one of said current-carrying extensions at a point in the central region of such current-carrying extension and above the aperture means therein and a lower leg joined to and inclining away in the opposite direction from the inner vertical margin of the other current-carrying extensions at a point in the central region of such current-carrying extension and below the anchoring aperture means therein.

13. The plug-in fuse assembly of claim 12 wherein said fuse link has a central leg connected by curved portions to said upper and lower end portions to form a generally elongated S-shaped fuse link.

14. The plug-in fuse assembly of claim 13 wherein said end portions and central leg are substantially straight.

15. The plug-in fuse assembly of claim 14 wherein said end portions and central leg are inclined at an angle of the order of 45 degrees to the length of the current-carrying extensions.

16. The plug-in fuse assembly of claim 13 wherein the width of the upper and lower end portions of said fuse link is only a small fraction of the length thereof, and the length of said upper and lower end portions of the fuse link is at least about half the length of said central leg thereof.

* * * * *